US006770612B1

(12) United States Patent
Hatchman

(10) Patent No.: US 6,770,612 B1
(45) Date of Patent: Aug. 3, 2004

(54) STRUCTURED SURFACTANT SYSTEMS

(75) Inventor: Kevan Hatchman, Bromsgrove (GB)

(73) Assignee: Huntsman International LLC, Salt Lake City, UT (US)

( * ) Notice: Subject to any disclaimer, the term of this patent is extended or adjusted under 35 U.S.C. 154(b) by 157 days.

(21) Appl. No.: 10/018,818

(22) PCT Filed: Jun. 22, 2000

(86) PCT No.: PCT/GB00/02448

§ 371 (c)(1),
(2), (4) Date: Mar. 20, 2002

(87) PCT Pub. No.: WO01/00779

PCT Pub. Date: Jan. 4, 2001

(30) Foreign Application Priority Data

Jun. 24, 1999 (GB) ..... 9914671

(51) Int. Cl.[7] ..... C11D 3/37

(52) U.S. Cl. ..... 510/398; 510/276; 510/318; 510/334; 510/371; 510/434; 510/507; 510/533

(58) Field of Search ..... 510/276, 318, 510/334, 371, 434, 507, 533, 398

(56) References Cited

U.S. PATENT DOCUMENTS

| | | | | | |
|---|---|---|---|---|---|
| 4,931,195 | A | * | 6/1990 | Cao et al. | 510/304 |
| 4,992,194 | A | * | 2/1991 | Liberati et al. | 510/303 |
| 5,281,355 | A | * | 1/1994 | Tsaur et al. | 510/393 |
| 5,409,629 | A | * | 4/1995 | Shulman et al. | 510/337 |
| 5,529,724 | A | * | 6/1996 | Falk | 510/417 |
| 6,090,762 | A | * | 7/2000 | Clapperton et al. | 510/108 |
| 6,177,396 | B1 | * | 1/2001 | Clapperton et al. | 510/405 |

* cited by examiner

*Primary Examiner*—Charles Boyer
(74) *Attorney, Agent, or Firm*—Christopher Whewe, II

(57) ABSTRACT

Structured surfactant systems contain a deflocculant and, in addition, an auxiliary stabiliser to inhibit temperature instability. The auxiliary stabiliser comprises a substantially non cross-linked water soluble copolymer having a hydrophulic back-bone and sufficient $C_{2-6}$ hydrophobic organic side chains to permit entanglement of the polymer chains.

20 Claims, No Drawings

STRUCTURED SURFACTANT SYSTEMS

The present invention relates to the formulation of structured surfactant suspending systems. It is particularly relevant to the formulation of laundry detergents especially those used for industrial and institutional cleaning.

STRUCTURE SURFACTANT

Suspending solids in liquids presents a problem. If the solids differ in density from the liquid they will tend either to sediment or float. Increasing the viscosity of the liquid can retard, but not prevent such separation, and high viscosities are generally undesirable. Colloidal systems, in which the suspended particles are sufficiently small to experience Brownian motion, e.g. less than 1 micron, may be kinetically stable. However the difficulty or undesirability of comminuting some solids to such sizes, and the impossibility of maintaining many of them at this level in the face of crystal growth or agglomeration, limits the use of colloidal suspensions.

Adjusting the density of one phase to match that of the other is usually impracticable. Moreover such systems are almost always temperature-unstable due to differential rates of thermal expansion.

One method of suspension which permits even relatively large particles to be stably suspended is structured surfactant The term covers systems in which a surfactant mesophase, usually a lamellar or G-phase, alone or more usually interspersed with an aqueous phase, provides a yield stress which is sufficient, when the system is at rest, to immobilise any suspended particles, but which is sufficiently low to allow the system to be poured like a normal liquid. Such systems may display very low apparent viscosities when stirred, pumped or poured and yet be capable of maintaining particles, sometimes of millimeter or larger size, indefinitely in suspension.

Three main types of suspending system have been employed in practice, all involving a G-phase, in which bilayers of surfactant are arranged with the hydrophobic part of the molecule on the interior and the hydrophilic part on the exterior of the bilayer (or vice versa). The bilayers lie side by side, e.g. in a parallel or concentric configuration, sometimes separated by aqueous layers. G-phases (also known as $L_\alpha$ phases) can usually be identified by their characteristic textures under the polarising microscope and/or by x-ray diffraction, which is often able to detect evidence of lamellar symmetry. Such evidence may comprise first, second and sometimes third order peaks with d-spacing $$\left(\frac{2\Pi}{Q} \text{ where } Q \text{ is the momentum transfer vector}\right)$$

in a simple integral ratio 1:2:3. Other types of symmetry give different ratios, usually non integral.

Most surfactants form a G-phase either at ambient or at some higher temperature when mixed with water in certain specific proportions. However such G-phases cannot usually be used as structured suspending systems. Useful quantities of solid render them unpourable and smaller amounts tend to sediment.

The main types of structured system used in practice are based on dispersed lamellar, spherulitic and attenuated lamellar phases. Dispersed lamellar phases are two phase systems in which the surfactant bilayers are arranged as parallel plates to form domains of G-phases which are interspersed with an aqueous phase to form an opaque gel-like system. They are described in EP O 086 614.

Spherulitic phases comprise well defined spheroidal bodies, usually referred to in the art as spherulites, in which surfactant bilayers are arranged as concentric shells. The spherulites usually have a diameter in the range 0.1 to 15 microns and are dispersed in an aqueous phase in the manner of a classical emulsion, but interacting to form a structured system. Spherulitic systems are described in more detail in EP O 151 884.

Many structured surfactant systems are intermediate between dispersed lamellar and spherulitic, involving both types of structure. Usually systems having a more Spherulitic character are preferred because they tend to have lower viscosity. A variant on the spherulitic system comprises prolate or rod shaped bodies sometimes referred to as batonets.

A third type of structured surfactant system comprises an expanded G-phase. It differs from the other two types of structure system in being essentially a single phase, and from conventional G-phase in having a wider d-spacing. Conventional G-phases have a d-spacing of about 5 to 7 nanometers. Attempts to suspend solids in such phases results in stiff pastes which are either non-pourable, unstable or both Expanded G-phases with d-spacing between 8 and 20, e.g. 10 to 15 nanometers, form when the electrolyte is added to aqueous surfactants at concentrations just below those required to form a normal G-phase, particularly to surfactants in the M phase. The M phase comprises surfactant molecules arranged to form cylindrical rods of indefinite length. It exhibits hexagonal symmetry and a distinctive texture under the polarising microscope. Typical M phases have so high a viscosity that they appear to be curdy solids. M phases near the lower concentration limit (the $L_1$/M phase boundary) may be pourable but have a very high viscosity and often a mucous-like appearance. Such systems tend to form expanded G-phases particularly readily on addition of sufficient electrolyte.

Expanded G-phases are described in more detail in EP O 530 708. In the absence of suspended matter they are translucent, unlike dispersed lamellar or spherulitic phases which are necessarily opaque. They arm optically anisotropic and have shear dependent viscosity. In this they differ from $L_1$ phases which are micellar solutions and which include microemulsions. $L_1$ phases are clears optically isotropic and substantially Newtonian. They are unstructured and cannot suspend solids. Some $L_1$ phases exhibit small angle x-ray diffraction spectra which show evidence of hexagonal symmetry. Such phases usually have concentrations near the $L_1$/M phase boundary and may form expanded G-phases on addition of electrolyte.

Most structured surfactant systems require the presence of electrolyte as well as surfactant and water in order to form structured systems capable of suspending solids. However certain relatively hydrophobic surfactants such as isopropylamine alkyl benzene sulphonate can form spherulites in water in the absence of electrolyte. Such surfactants are capable of suspending solids in the absence of electrolyte as described in EP O 414 549.

The Problem

A problem with the two phase structured surfactant systems, and especially spherulitic systems, is flocculation of the dispersed surfactant structures. This tends to occur at high surfactant and/or high electrolyte concentration. It can have the effect of making the composition very viscous and/or unstable with the dispersed surfactant separating from the aqueous phase.

The Prior Art

Certain amphiphilic polymers have been found to act as deflocculants of structured surfactants. One type of deflocculant polymer exhibits cteniform (comb-shaped) architecture with a hydrophilic backbone and hydrophobic side chains or vice versa. A typical example is a random copolymer of acrylic acid and a fatty alkyl acrylate. Cteniform deflocculants have been described in a large number of patents, for example WO-A-9106622.

A more effective type of deflocculant has surfactant rather than cteniform architecture. With a hydrophilic polymer group attached at one end to a hydrophobic group. Such deflocculants are typically telomers formed by telomerising a hydrophilic monomer with a hydrophobic telogen. Examples of surfactant deflocculants include alkyl thiol polyacrylates and alkyl polyglycosides. Surfactant deflocculants are described in more details in EP O 623 670.

A disadvantage of both surfactant and cteniform deflocculants is that the concentration required to deflocculate to the extent required for optimum viscosity is critical within fairly narrow limits and varies with temperature. Either too much or too little deflocculant causes instability and/or excessive viscosity. As a result the deflocculated systems tend to separate or congeal if the temperature varies significantly. In particular, separation of a clear bottom layer is often observed on storage.

One approach to the problem of temperature stability has been to add highly cross linked polyacrylates (see U.S. Pat. No. 5,602,092). These, however, are difficult to disperse in the structured liquid.

Structured surfactants have been applied to the problems of suspending: water insoluble or sparingly soluble builders in laundry detergent; antifoams and enzymes in laundry detergents and other surfactant systems; abrasives in hard surface cleaners; pesticides and oils in agrochemical preparations; rock cuttings in drilling muds; dyestuffs in dyebath concentrates and printing inks; talcs, oils and other cosmetic ingredients in personal care formulations.

The Solution

We have now discovered that a substantially non-cross linked polymer having a hydrophilic backbone and sufficient short (e.g. $C_{1\ to\ 5}$) side chains to enhance physical entanglement of the polymer molecules has the ability to stabilise deflocculated structured surfactant systems, but is more soluble and easier to disperse than the cross linked polymers used hitherto.

The Invention

Our invention provides a structured surfactant composition capable of suspending solids which comprises surfactant water and, if required, electrolyte in relative proportions adapted to form a flocculated, dispersed lamellar and/or spherulitic structured surfactant system, and, in addition, sufficient of a deflocculant to inhibit the flocculation of said system characterised in that said composition comprises an effective amount of an auxiliary stabiliser which is a substantially non-cross linked, water-soluble copolymer having a hydrophilic backbone and sufficient $C_{2-6}$ hydrophobic organic side chains to permit entanglement of the polymer chain. For convenience as used herein "side chain" includes cyclic side chains such as a benzene, cyclohexane or cyclopentane ring, attached to the hydrophilic backbone.

The Auxiliary Stabiliser

The auxiliary stabiliser may be a copolymer of (a) one or more unsaturated carboxylic or dicarboxylic acids having from 3 to 6 carbon atoms and/or vinyl alcohol with (b) styrene and/or a $C_{1\ to\ 5}$ alkyl ester of a $C_{3\ to\ 6}$ unsaturated carboxylic or dicarboxylic acid and/or a vinyl alcohol ester of a $C_{2\ to\ 6}$ carboxylic acid wherein the mole ratio of (a):(b) is from 0.01 to 10, preferably more than 0.1, especially more than 0.2, e.g. more than 0.5, but preferably less than 8, especially less than 5, e.g. less than 2. The polymer is substantially non-cross linked by which is meant that it comprises less than 0.05% cross lining and/or insufficient cross linking to provide pseudo plastic behaviour. Preferably the auxiliary stabiliser gives the formulation a Sisko Index of 0.1 to 0.4, e.g. 0.2 to 3.

The polymer is preferably present in an amount of from 0.01 to 10% by weight of the composition e.g. 0.05 to 5%, especially 0.1 to 2%, e.g. 0.5 to 1.5% by weight.

The polymer may preferably be a copolymer of acrylic acid with for example ethyl, propyl or butyl acrylate and/or styrene. Alternatively, a copolymer comprising vinyl alcohol and vinyl acetate propionate or butyrate residues could be used. Other mononomers include maleic acid, fumaric acid, citraconic acid, aconitic acid, itaconic acid, crotonic acid, isocrotonic acid, angelic acid and tiglic acid and their esters or partial esters. The effectiveness of the auxiliary stabiliser may be enhanced by the presence of a clay such as bentonite. The latter, however, is not normally sufficient to stabilise the composition in the absence of the polymer. Particularly preferred are water dispersible synthetic layered silicates such as that sold by Laporte under its Registered Trade Mark "LAPONITE".

It has been found that clays and, in particular, synthetic layered silicates are synergistic with the copolymeric auxiliary stabilisers. This provides a further aspect of the invention. The clay is generally used in amounts between 0.01 and 10% by weight of the composition. Typically using clays such as bentonite, proportions of from 0.1 to 8% may be used, more usually 0.5 to 5%, e.g. 1 to 3%. However, synthetic layered silicates are effective in substantially lower concentrations e.g. 0.01 to 2%, e.g. 0.05 to 1%, especially 0.1 to 0.5% by weight. Use of the clay or silicate permits the proportion of copolymer to be substantially reduced, e.g. 0.01 to 0.5% by weight based on the weight of the composition.

The invention therefore provides, according to a further embodiment an auxiliary stabiliser for deflocculated structured surfactants which comprises from 10 to 90% by weight of a copolymer having a hydrophilic backbone and $C_{2\ to\ 6}$ hydrophobic side chains, with from 90 to 10% by weight of a natural or synthetic clay.

Deflocculant

The deflocculant may be a surfactant deflocculant including any of those referred to in EP O 623 670. Particularly preferred are the alkyl thiol polycarboxylate telomers such as a $C_{8-20}$ alkyl thiol polyacrylate or polymaleate and alkyl polyglycosides such as $C_{8-20}$ alkyl polyglucoside e.g. having a D.P. greater than 1.2, preferably greater than 1.5. Alternatively the stabiliser may be a cteniform polymer of the type described in WO-A-9106622. The deflocculant is typically present in the amount required to deflocculate the system. This depends on the nature of the surfactant and of the deflocculant but is typically in the range 1 to 5% although higher concentrations may be required in some cases.

Surfactant

Compositions according to the present invention generally contain at least sufficient surfactant to form a structured system. For some surfactants this may be as low as 2% by weight, but more usually requires at least 3%, especially at least 4%, typically more than 5% by weight of surfactant.

Detergent compositions of the present invention preferably contain at least 10% by weight of total surfactant (including the deflocculant, where the latter is a surfactant) based on the total weight of the composition. Most preferably the total surfactant is at least 20%, especially more than 25%, e.g. more than 30% by weight of the composition. It is unlikely in practice that the surfactant concentration will exceed 80% based on the weight of the composition and is usually less than 70% especially less than 60%, typically less than 50% e.g. less than 40% by weight of the composition.

The amount of surfactant present in the composition is preferably greater than the minimum which is able, in the presence of a sufficient quantity of surfactant-desolubilising electrolyte, to form a stable, solids-suspending structured surfactant system.

The surfactant may comprise anionic, cationic, non-ionic, amphoteric semi polar and/or zwitterionic species or mixtures thereof.

Anionic surfactant may comprise a $C_{10-20}$ alkyl benzene sulphonate or an alkyl ether sulphate which is preferably the product obtained by ethoxylating a natural fatty or synthetic $C_{10-20}$ e.g. a $C_{12-14}$ alcohol with from 1 to 20, preferably 2 to 10 e.g. 3 to 4 ethyleneoxy groups, optionally stripping any unreacted alcohol, reacting the ethoxylated product with a sulphating agent and neutralising the resulting alkyl ether sulphuric acid with a base. The term also includes alkyl glyceryl sulphates, and random or block copolymerised alkyl ethoxy/propoxy sulphates.

The anionic surfactant may also comprise, for example, $C_{10-20}$ e.g. $C_{12-18}$ alkyl sulphate.

The surfactant may comprise a $C_{8-20}$ e.g. $C_{10-18}$ aliphatic soap. The soap may be saturated or unsaturated, straight or branched chain.

Preferred examples include dodecanoates, myristates, stearates, oleates, linoleates, linolenates and palmitates and coconut and tallow soaps. Where foam control is a significant factor we particularly prefer to include soaps e.g. ethanolamine soaps and especially monothanolamine soaps, which have been found to give particularly good cold storage and laundering properties.

The surfactant may include other anionic surfactants, such as olefin sulphonates, paraffin sulphonates, taurides, isethionates, ether sulphonates, ether carboxylates, aliphatic ester sulphonates, e.g. alkyl glyceryl sulphonates, sulphosuccinates or sulphosuccinates. Preferably the other anionic surfactants are present in total proportion of less than 45% by weight, based on the total weight of surfactants, more preferably less than 40%, most preferably less than 30%, e.g. less than 20%.

The cation of any anionic surfactant is typically sodium but may alternatively be potassium, lithium, calcium, magnesium, ammonium, or an alkylammonium having up to 6 aliphatic carbon atoms including isopropylammonium, monoethanolammoniun, diethanolammonium, and triethanolammonium. Mixtures of the above cations may be used.

The surfactant preferably contains one, or preferably more, non-ionic surfactant. These preferably comprise alkoxylated $C_{8-20}$ preferably $C_{12-18}$ alcohols. The alkoxylates may be ethoxylates, propoxylates or mixed ethoxylated/propoxylated alcohols. Particularly preferred are ethoxylates with 2 to 20 especially 2.5 to 15 ethyleneoxy groups.

The alcohol may be fatty alcohol or synthetic e.g. branched chain alcohol. Preferably the non-ionic component has an HLB of from 6 to 16.5, especially from 7 to 16, e.g. 8 to 15.5. We particularly prefer mixtures of two or more non-ionic surfactants having a weighted mean HLB in accordance with the above values.

Other ethoxylates and/or propoxylated non-ionic surfactants which may be present include $C_{6-16}$ alkylphenol alkoxylates, alkoxylated fatty acids, alkoxylated amines, alkoxylated alkanolainides and alkoxylated alkyl sorbitan and/or glyceryl esters.

Other non-ionic sufactants which may be present include amine oxides, fatty alkanolamides such as coconut monoethanolamide, and coconut diethanolamide and alkylaminoethyl fructosides and glucosides.

The proportion by weight of non-ionic surfactant is preferably at least 2% and usually more than 10%, more typically more than 20%, e.g. 30 to 75%, especially 40 to 60% based on the total weight of surfactant However compositions wherein the non-ionic surfactant is from 75 to 100% of the total weight of the surfactant are included and may be preferred for some applications.

The surfactant may be, or may comprise major or minor amounts of, amphoteric and/or cationic surfactants, for example betaines, sulphobetaines, amidobetaines, imidazolines, amidoamines, quaternary ammonium surfactants and cationic fabric conditioners having two long chain alkyl groups, such as tallow groups. Examples of fabric conditioners which may be deflocculated according to our invention include ditallowyl dimethyl ammonium salts, ditallowyl methyl benzyl ammonium salts, ditallowyl imidazolines, ditallowyl amidoamines and quaternised ditallowyl imidazolines and amidoamines. The anion of the fabric conditioner may for instance be or may comprise methosulphate, chloride, sulphate, acetate, lactate, tartrate, citrate or formate. We prefer that the compositions of our invention do not contain substantial amounts of both anionic and cationic surfactants.

We particularly prefer that the surfactant consists essentially of a mixture of a non-ionic ethoxylate with an amine oxide or, preferably an amphoteric surfactant. Such mixtures exhibit strong synergistic soil removal. The mixture may desirably contain from 1:10 to 10:1 weight ratio of non-ionic to amphoteric e.g. 1:5 to 5:1.

Suspended Solids

A major advantage of the preferred compositions of the invention is their ability to suspend solid particles to provide non-sedimenting pourable suspension. Optionally the composition may contain up to, for example, 80% by weight, based on the weight of the composition, of suspended solids, more usually up to 30 e.g. 10 to 25%. The amount will depend on the nature and intended use of the composition. For example in detergent compositions it is often desired to include insoluble builder such as zeolite or sparingly soluble builders such as sodium tripolyphosphate which may be suspended in the structured surfactant medium.

The surfactant systems according to our invention may also be used to suspend abrasives such as talc, silica, calcite or coarse zeolite to give hard surface cleaners; or pesticides, to provide water dispersible, pourable compositions containing water insoluble pesticides, without the hazards of toxic dust or environmentally harmful solvents. They are useful in providing suspensions of pigments, dyes, pharmaceuticals, biocides, or as drilling muds, containing suspended shale and/or weighting agents such as sodium chloride, calcite, barite, galena or haematite.

They may be used to suspend exfoliants including talc, clays, polymer beads, sawdust, silica, seeds, ground nutshells or dicalcium phosphate, pearlisers such as mica, glycerol mono- or di-stearate or ethylene glycol mono- or di-stearate, natural oils, including mineral and glyceride oils such as coconut, evening primrose, groundnut, meadow foam, apricot kernel, avocado, peach kernel or jojoba oils, essential oils, synthetic oils such as silicone oils, vitamins, anti dandruff agents such as zinc omadine, and selenium disulphide, proteins, emollients such as lanolin or isopropylmyristate, waxes and sunscreens such as titanium dioxide and zinc oxide.

Builders

We prefer that detergent compositions of our invention contain dissolved builder and/or suspended particles of solid builder, to provide a fully built liquid detergent "Builder" is used herein to mean a compound which assists the washing action of a surfactant by ameliorating the effects of dissolved calcium and/or magnesium. Generally builders also help maintain the alkalinity of wash liquor. Typical builders include sequestrants and complexants such as sodium tripolyphosphate, potassium pyrophosphate, trisodium phosphate, sodium ethylene diamine tetracetate, sodium citrate or sodium nitrilo-triacetate, ion exchangers such as zeolites and precipitants such as sodium or potassium carbonate and such other alkalis as sodium silicate. Said stabiliser also contributes to the total builder. The preferred builders are zeolite and sodium tripolyphosphate. The builder may typically be present in concentrations up to 50% by weight of the composition e.g. 15 to 30%.

pH

The pH of a composition for laundry use is preferably alkaline, as measure after dilution with water to give a solution containing 1% by weight of the composition, e.g. 7 to 12, more preferably 8 to 12, most preferably 9 to 11.

Hydrotropes

Compositions of our invention may optionally contain small amounts of hydrotropes such as sodium xylene sulphonate, sodium toluene sulphonate or sodium cumene sulphonate, e.g. in concentrations up to 5% by weight based on the total weight of the composition, preferably not more than 2%, e.g. 0.1 to 1%. Hydrotropes tend to break surfactant structure and it is therefore important not to use excessive amounts. They are primarily useful for lowering the viscosity of the formulation, but too much may render the formulation unstable.

Solvents

The compositions may contain solvents, in addition to water. However, like hydrotropes, solvents tend to break surfactant structure. Moreover, again like hydrotropes, they add to the cost of the formulation without substantially improving the washing performance. They are moreover undesirable on environmental grounds and the invention is of particular value in providing solvent-free compositions. We therefore prefer that they contain less than 6%, more preferably less than 5%, most preferably less than 3%, especially less than 2%, more especially less than 1%, e.g. less than 0.5% by weight of solvents such as water miscible alcohols or glycols, based on the total weight of the composition. We prefer that the composition should essentially be solvent-free, although small amounts of glycerol and propylene glycol are sometimes desired. Concentrations of up lo about 3% by weight, e.g. 1 to 2% by weigh of ethanol are sometimes required to enhance perfume. Such concentrations can often be tolerated without destabilising the system.

Polymers

Compositions of our invention may contain various polymers. In particular it is possible to incorporate useful amounts of polyelectrolytes such as uncapped polyacrylates or polymaleates. Such polymers may be useful because they tend to lower viscosity and because they have a detergent building effect and may have anticorrosive or antiscaling activity. Unfortunately they also tend to break surfactant structure and cannot normally be included in structured surfactants in significant amounts without destabilizing the system. We have discovered that relatively high levels of polyclectrolytes can be added to structured detergents in conjunction with deflocculated polymers and auxiliary stabilisers of the invention without destabilising the structure. This can provide stable products of even lower viscosity than can be achieved with the deflocculant and auxiliary stabiliser alone.

Some examples of polymers which may be included in the formulation are antiredeposition agents such as sodium carboxymethyl cellulose, antifoams such as silicone antifoams, enzyme stabilisers such as polyvinyl alcohols and polyvinyl pyrrolidone, dispersants such as lignin sulphonates and encapsulents such as gums and resins. We have found that milling aids such as sodium dimethylnapthalene sulphonate/formaldehyde condensates are useful where the solid suspended in the composition requires milling as in the case of dye or pesticide formulations.

The amount of polymer added depends on the purpose for which it is used. In some cases it may be as little as 0.01% by weight, or even lower. More usually it is in the range of 0.1 to 10%, especially 0.2 to 5%, e.g. 0.5 to 2% by weight.

Other Detergent Additives

The solid suspending detergent compositions of our invention may comprise conventional detergent additives such as antiredeposition agents (typically sodium carboxymethyl cellulose), optical brighteners, sequestrants, antifoams, enzymes, enzyme stabilisers, preservatives, dyes, pigments, perfumes, fabric conditions, e.g. cationic fabric softeners or bentonite, opacifiers, bleach activators and/or chemically compatible bleaches. We have found that peroxygen bleaches such as sodium perborate, especially bleaches that have been protect e.g. by encapsulation, are more stable to decomposition in formulations according to our invention than in conventional liquid detergents. Generally all conventional detergent additives which are dispersible in the detergent composition as solid particles or liquid droplets, in excess of their solubility in the detergent, and which are not chemically reactive therewith may be suspended in the composition.

Applications

In addition to providing novel laundry detergents, fabric conditioners and scouring creams the stabilised structured surfactants of our invention may be used in toiletries, including shampoos,liquid soaps, creams, lotions, balms, ointments, antiseptics, dentifrices and styptics.

They provide valuable suspending media for dye and pigment concentrates and printing inks, pesticide concentrates and drilling muds. In the presence of dense dissolved electrolytes such as calcium bromide they are particularly useful for oilfield packing fluids (used to fill the gap between the pipe and the inside of the borehole, to protect the former from mechanical stresses) and completion fluids in oil well, or as cutting fluids or lubricants.

The invention will be illustrated by the following examples.

EXAMPLE 1

| | | % a.i. |
|---|---|---|
| "ACUSOL" ® 842 | non cross-linked acrylic acid/ethylacrylate copolymer | 0.21 |
| NaOH | 50% soluton | 0.12 |
| "LAUNDROSIL" ® DGA | bentonite clay | 1.67 |
| "EMPIGEN" ® BB | $C_{12-14}$ alkyl betaine | 2.25 |
| "BEVALOID" ® XB16/01H | $C_{16}$ alkylthiolpolyacrylate | 0.10 |
| "EMPILAN" ® KBE3 | $C_{12-14}$ alkyl 3 mole ethoxylate | 4.42 |
| "WACKER" ® S131 | silicone antifoam | 0.13 |
| "BRIQUEST" ® 543/25S | phosphonate | 0.42 |
| "TINOPAL" ® CBS/X | optical brightener | 0.06 |
| | sodium carboxymethyl cellulose | 0.08 |
| | calcium chloride | 0.21 |
| "ALCALASE" ® CX | protease enzyme | 0.08 |
| "TERMAMYL" ® 300L | amylase enzyme | 0.08 |
| "PROXEL" ® | preservative | 0.02 |
| | boric acid | 0.83 |
| Non-bio 32 | perfume | 0.33 |
| STP/1L | sodium tripolyphosphate | 20.8 |
| | water | Balance |

The above formulation was mobile and stable after three months storage. In the absence of the "ACUSOL" copolymer the composition underwent slow separation of a clear bottom layer over several weeks. This separation could not be prevented by increasing the amount of bentonite, even up to double the amount. In the absence of the bentonite some separation occurred which could be prevented by increasing the amount of "ACUSOL" copolymer.

EXAMPLE 2

| | | % a.i. |
|---|---|---|
| "LAPONITE" ® RD | syntethic layer silicate clay | 0.2 |
| "ACUSOL" ® 842 | non cross linked acrylic acid/ethyl acrylate copolymer | 0.3 |
| NaOH | sodium hydroxide | 0.17 |
| "EMPIGEN" ® BB | $C_{12-14}$ alkyl betaine | 2.75 |
| "BEVALOID" ® XB16/01H | alkylthiol polyacrylate | 0.16 |
| "EMPILAN" ® KBE3 | $C_{12-14}$ alcohol 3EO ethoxylate | 4.95 |
| "WACKER" ® S131 | silicone antifoam | 0.25 |
| | sodium tripolyphosphate | 21.9 |
| "BRIQUEST" ® 543/25S | amino phosphonate | 0.27 |

-continued

| | | % a.i. |
|---|---|---|
| "REPELOTEX" ® QCJ | soil release polymer | 0.3 |
| | water | Balance |

Viscosity 1000 cps (Brookfield Spindle4 100 rpm)

The composition was stable on storage. Without the "ACUSOL" copolymer and "LAPONITE" synthetic clay the composition underwent rapid sedimentation. In the absence of the "ACUSOL" copolymer the composition could only be stabilised by the use of uneconomically high proportions of the clay.

In the absence of the clay, substantially higher concentrations of the "ACUSOL" copolymer were required which were significantly less cost effective than the mixture.

What is claimed is:

1. A structured surfactant composition capable of suspending solids which comprises surfactant, water and, if required, electrolyte in relative proportions adapted to form a flocculated, dispersed lamellar and/or spherulitic structured surfactant system, and, in addition, a sufficient amount of a deflocculant to inhibit the flocculation of said system characterised in that said composition comprises an effective amount of an auxiliary stabiliser which is a substantially non-cross linked, water-soluble co-polymer having a hydrophilic backbone and sufficient $C_{2-6}$ hydrophobic organic side chains to permit entanglement of the polymer chain.

2. A composition according to claim 1 wherein said auxiliary stabiliser is a copolymer of an unsaturated carboxylic or dicarboxylic acid having from 3 to 6 carbon atoms and a $C_1$ to $_5$ alkyl ester of such an acid.

3. A composition according to claim 2 wherein said acid is acrylic acid.

4. A composition according claim 2 wherein said ester is an ethyl, propyl, or butyl ester of said acid.

5. A composition according to claim 2 wherein the ratio of said acid to said ester is from 0.01 to 10.

6. A composition according to claim 1 wherein said auxiliary stabiliser is present in a amount of from 0.05 to 5% by weight of the composition.

7. A composition according to claim 1 which additionally contains from 0.01 to 10% by weight of the composition of a clay.

8. A composition according to claim 7 wherein said clay is a water dispersible synthetic layer silicate.

9. An auxiliary stabiliser for deflocculated structured surfactants which comprised from 10 to 90% by weight of a co-polymer having a hydrophilic backbone and $C_2$ to $a_6$ hydrophobic side chains, with from 90 to 10% by weight of a natural or synthetic clay.

10. A composition according to claim 3 wherein said ester is an ethyl, propyl, or butyl ester of said acid.

11. A composition according to claim 3 wherein the ratio of said acid to said ester is from 0.01 to 10.

12. A composition according to claim 4 wherein the ratio of said acid to said ester is from 0.01 to 10.

13. A composition according to claim 2 wherein said auxiliary stabiliser is present in an amount of from 0.05 to 5% by weight of the composition.

14. A composition according to claim 3 wherein said auxiliary stabiliser is present in an amount of from 0.05 to 5% by weight of the composition.

15. A composition according to claim 4 wherein said auxiliary stabiliser is present in an amount of from 0.05 to 5% by weight of the composition.

16. A composition according to claim 5 wherein said auxiliary stabiliser is present in an amount of from 0.05 to 5% by weight of the composition.

17. A composition according to claim 2 which additionally contains from 0.01% to 10% by weight of the composition of a clay.

18. A composition according to claim 3 which additionally contains from 0.01% to 10% by weight of the composition of a clay.

19. A composition according to claim 4 which additionally contains from 0.01% to 10% by weight of the composition of a clay.

20. A composition according to claim 5 which additionally contains from 0.01% to 10% by weight of the composition of a clay.

* * * * *